United States Patent [19]

Magyar et al.

[11] Patent Number: 4,824,589

[45] Date of Patent: Apr. 25, 1989

[54] RUST CONVERTING AND REMOVING COMPOSITIONS

[75] Inventors: Arpad M. Magyar, Conroe, Tex.; Darrell W. Patton, Wichita, Kans.; Paul J. DesLauriers, Conroe, Tex.

[73] Assignee: Pennzoil Products Company, Houston, Tex.

[21] Appl. No.: 892,443

[22] Filed: Aug. 4, 1986

[51] Int. Cl.[4] ..... C02F 5/10; B08B 7/00

[52] U.S. Cl. ..... 252/82; 252/142; 252/146; 252/387; 252/388; 257/399; 134/3; 134/41; 134/4

[58] Field of Search ..... 252/142, 105, 82, 87, 252/524, 527, 542, 546, 174.14, 174.19, DIG. 3; 134/3, 4, 41

[56] References Cited

U.S. PATENT DOCUMENTS

| | | | |
|---|---|---|---|
| 3,173,864 | 3/1965 | Freedman | 210/57 |
| 3,639,278 | 2/1972 | Hwa | 252/146 |
| 3,699,047 | 10/1972 | Petrey, Jr. | 252/81 |
| 3,766,077 | 10/1973 | Hwa et al. | 252/180 |
| 4,086,182 | 4/1978 | Hengelhaupt et al. | 252/182 |
| 4,529,450 | 7/1985 | Panayappan | 134/4 |
| 4,595,517 | 6/1986 | Abadi | 252/142 |

OTHER PUBLICATIONS

Chemical Abstracts, CA 108(8):57754b.

*Primary Examiner*—Paul Lieberman
*Assistant Examiner*—John F. McNally
*Attorney, Agent, or Firm*—Lowe, Price, LeBlanc, Becker & Shur

[57] ABSTRACT

A rust converting composition comprises ascorbic acid, lignin sulfonate, and a water insoluble polymer, such as polyvinylpyrrolidone, and optionally a thickener. The invention further provides a method for removing rust from rusted metal surfaces by applying the composition, allowing the composition to remain on the rusted metal surface until substantially all of the rust is converted to a water soluble form, and removing the composition from the metal surface by washing with water.

16 Claims, 1 Drawing Sheet

RUST REMOVAL vs. TIME FOR PRODUCT COATINGS

RUST REMOVAL vs. TIME FOR PRODUCT COATINGS

RUST CONVERTING AND REMOVING COMPOSITIONS

FIELD OF THE INVENTION

This invention relates to rust conversion compositions for use in removing rust from metal surfaces. The composition comprises ascorbic acid, a lignin sulfonate, and a polymer vehicle.

BACKGROUND

Prior art rust removers generally contain high concentrations of phosphoric acid. The use of phosphoric acid in these products presents several disadvantages. Since phosphoric acid is such a strong acid, it must be handled with caution, and therefore may be disadvantageous for use in consumer products. Rust removers containing phosphoric acid are generally applied using rubber gloves and the additional use of rubber aprons is frequently recommended. In addition, phosphoric acid disposal is a problem in products which are rinsed with water. Phosphates enter the environment and are known to cause or accelerate algae bloom. Further, since phosphoric acid is a strong acid, its corrosive effects do not stop completely at the surface of the metal after the rust has been removed. Overexposure of the metal to a phosphoric acid containing product can cause damage to the metal surface.

Other prior art rust removers contain sulfuric acid in combination with phosphoric acid. The sulfuric acid is stronger and more corrosive than the phosphoric acid, and thus these combination rust removers present even more hazards than with phosphoric acid alone.

Other prior art rust removers contain oxalic acid as the main active ingredient. Oxalic acid is also caustic and corrosive to the skin, and is highly toxic upon ingestion.

While most prior art rust transforming compositions require the use of one or more very caustic ingredients, a number of anti-corrosive compositions have been produced using relatively mild ingredients. U.S. Pat. No. 3,173,864 to Freedman discloses water treatment anti-corrosion compositions which contain a combination of a water-soluble lignosulfonate and a chromate salt. The composition may additionally contain organic acids, such as citric acid, gluconic acid or ethylene diamine tetra-acetic acid.

U.S. Pat. No. 3,639,278 to Hwa discloses a scale removing and inhibiting composition containing lignosulfonic acid and glycolic acid.

U.S. Pat. No. 3,766,077 to Hwa et al discloses scale-inhibiting compositions comprising lignosulfonic acid or sulfonates and water-soluble organic polymers.

U.S. Pat. No. 4,529,450 to Panayappan discloses a metal oxide removing composition which contains a water soluble polymer, erythorbic acid, a surfactant, a buffer, and optionally ascorbic acid and citric acid. The composition is one adapted to be sprinkled as a powder onto a wetted oxidized surface and then rinsed off or dissolved in water and applied to the metal surface. The powder or aqueous solution, however, are not very suitable for application as a coating, especially to a vertical surface.

As stated above, these compositions contain less caustic components than prior art rust removing compositions and the components have the added advantage of being more environmentally compatible upon disposal. Thus, it would be advantageous to produce a rust conversion and removing composition containing less caustic, environmentally stable components than prior art rust conversion compositions which are useful even when applied to a vertical surface.

SUMMARY OF THE INVENTION

It is an object of the present invention to provide a rust converting and removing composition which contains ingredients which are less caustic and more environmentally compatible than prior art compositions. It is another object of the present invention to provide a rust converting and removing composition which is not corrosive to metal surfaces.

It is a further object of the present invention to provide a rust converting and removing composition which is sufficiently safe for consumer use and may be removed by washing with water.

It is a still further object of the present invention to provide a rust converting and removing composition composed of readily available, inexpensive materials which is of suitable viscosity for use on vertical surfaces.

Other objects and advantages of the present invention will become apparent as the description thereof proceeds.

In satisfaction of the foregoing objects and advantages, there is provided by the present invention a novel rust converting and removing composition comprising ascorbic acid, a lignin sulfonate, and a polymer, and optionally a thickener. The polymer ingredient is a water soluble polymer such as polyvinylpyrrolidone.

Also provided by the present invention is a method of removing rust from a rusted metal surface which comprises applying the composition of the present invention to the rusted metal surface, allowing said composition to remain on said rusted metal surface until most or all of the rust has been converted into a water soluble rust conversion product, and removing the composition containing the rust conversion product from the metal surface such as by washing with water.

BRIEF DESCRIPTION OF THE DRAWINGS

Reference is now made to the drawings of the application wherein.

DESCRIPTION OF PREFERRED EMBODIMENTS

Figure 1:
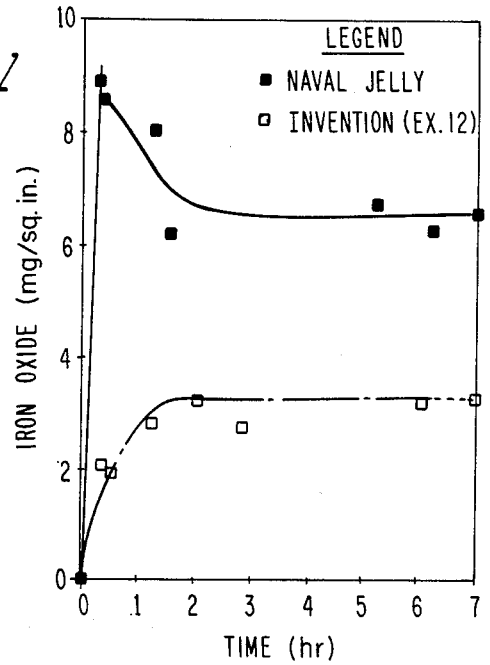
FIG. 1 is a graph showing rust removal effectiveness of the composition of the invention for product coatings as compared to the use of conventional naval jelly.

As indicated above, the present invention is directed to a rust converting and removing composition comprising ascorbic acid, a lignin sulfonate, and a polymer, and optionally a thickening agent. This composition is found to be more advantageous than prior art rust conversion compositions in that it contains non-corrosive, environmentally compatible materials, which do not harm the metal surface after removal of the rust. The invention further comprises methods of applying the composition to a rusted metal surface to convert the rust thereon to a water-soluble substance, and removing the substance from the metal surface.

As set forth above, the composition of the present invention contains ascorbic acid as one essential component. The ascorbic acid is believed to function as a reducing agent in the composition to reduce trivalent iron to divalent iron in the rust. Ascorbic acid also acts as a powerful penetrating agent, which has the ability to penetrate even deep layers of rust. Further, ascorbic acid is a nontoxic, relatively mild acid possessing a high degree of biodegradability, and is otherwise known as Vitamin C. Any form of ascorbic acid may be used including isomers as well as erythorbic acid, and mixtures thereof.

After the trivalent iron has been converted to divalent iron, the divalent ions must be chelated or sequestered in order to facilitate their removal from the surface. The chelating or sequestering agents of the present invention are lignin sulfonates. The lignin sulfonate component may be any alkali metal or ammonium lignin sulfonate such as sodium or potassium lignin sulfonate or mixtures. The preferred lignin sulfonate is sodium lignin sulfonate. The lignin sulfonates in the composition additionally act as surfactants to help penetrate the rust layers by lowering the surface tension of the composition. Further, they also serve as thickening agents, thus providing the composition with desired viscosity characteristics. The viscosity of the composition may be varied depending on the amount of lignin sulfonate employed therein. This can be advantageous when treating vertical surfaces where premature run-off of a low viscosity solution may not allow sufficient time and film thickness of the product to affect the conversion process. Lignin sulfonates, which are by-products of paper manufacturing processes, are inexpensive, nontoxic, and have a high degree of biodegradability. Thus, they are desirable for use in consumer products and are environmentally compatible.

The third essential ingredient of the composition is a polymer vehicle. The vehicle provides a site for the chemical reactions of the ascorbic acid and lignin sulfonate with the rusted metal surface. A number of different polymeric materials may be used including mixtures of the following listing of suitable polymers and copolymers. The preferred polymeric material of the present invention is a water soluble polymer. Any relatively inert, film forming water soluble polymer may be used which is compatible with the other components of the formulation. The preferred polymer of the present invention is polyvinyl pyrrolidone because it is non-toxic and suitable for consumer use. While polyvinylpyrrolidone (PVP) is preferred, other suitable polymers such as any of the methacrylic or acrylic polymers and the like may be used. Feasible polymers have an average molecular weight of 10,000 to 500,000 daltons. PVP K-90 TM, a commercially available PVP of average mol. wt=360,000 sold by GAF, is a suitable polymer.

Other polymers which may be used in the composition and method of the invention include polyacrylic acids, polyacrylamides, polyvinyl ethers, polyvinyl alcohols, and formaldehyde resins. Polymethylvinyl ether and polyethylene oxide in amounts of up to about 5% by weight are particularly preferred. Copolymers such as poly (alkyl/maleic anhydrides) and poly (vinyl ether/maleic anhydrides) are also suitable polymeric materials for use in the invention.

In a further embodiment of the invention, it is also desirable to include a thickening agent in the composition to increase viscosity of the mixture. Suitable thickening agents preferably include natural polymers such as cellulose ethers, cellulose esters, cellulose nitrate, polysaccharides, starch and derivatives. Specifically preferred materials include xanthan gum and hydroxyethyl cellulose in amounts of up to about 1% by weight. The incorporation of the suitable amount of thickeners into the composition will improve the viscosity of the composition for good adherence to the surfaces to be treated. In a preferred application, such thickened compositions may be used in the treatment of vertical surfaces. The amount of thickening agent or viscosity modifier which should be used will generally be in the range of about 0.1 to 1.5% by weight, which will be sufficient to increase the viscosity to the range of about 100 up to 5,000 Brookefield viscosity at 30 rpm using a #3 spindle.

It has been found that these essential ingredients of the present invention may be present in broadly varying proportions to each other, and still comprise an effective rust converting composition. Thus, the three active ingredients of the present invention may be present in the following amounts:

| | |
|---|---|
| Polymer | 5–75 wt. % |
| Lignin Sulfonate | 10–90 wt. % |
| Ascorbic Acid | 1–80 wt. % |
| Thickener | 0.1–1.5 wt. % |

More preferably, however, the active ingredients are present in the following amounts:

| | |
|---|---|
| Polymer | 5–40 wt. % |
| Lignin Sulfonate | 25–66 wt. % |
| Ascorbic Acid | 11–50 wt. % |
| Thickener | 0.1–1.5 wt. % |

It is also often desirable to add a preservative to the formulation in amounts of 0.1 to 1 wt. %. A useful commercial preservative is Proxeel CRL Biocide in amounts of 0.5 wt. %.

It is also desirable to incorporate into the composition buffering and corrosion inhibiting components in order to protect the cleaned metal surface with a subsequent application. The buffer of choice is sodium bicarbonate in amounts of 1.0 to 5.0 wt. %. The preferred corrosion inhibitor is any organic or inorganic water soluble corrosion inhibitor in amounts of 0.05 to 1.0 wt. %. Organic carboxylic acids and their salts are particularly useful as corrosion inhibitors.

In a preferred embodiment, the composition of the present invention is provided as an aqueous solution. In this embodiment, the composition is present in the solution or suspension in a concentration of 15–60%, preferably 25–45% by weight.

The present invention also provides methods for the application of the composition to rusted metal surfaces. The compositions may be brushed, sprayed, or applied by dipping to rusted surfaces. The composition or resulting product is a paintable liquid, particularly when it contains a thickening agent. The paintable liquid can be applied to the surface and will remain on the surface to effect cleaning. This is a particularly useful feature of the invention in the cleaning of vertical surfaces. The cleaning of vertical surfaces with powders or free flowing solutions as in U.S. Pat. No. 4,529,450 is a particular problem using product formulations of those types. The present invention overcomes these deficiencies.

Once applied, the compositions will form black coatings on the surfaces, generally within about 5–10 minutes. The composition is then allowed to remain on the surface until substantially all of the rust on the surface has been converted to a water soluble substance, usually within a few hours. The composition is then removed from the surface, exposing a clean, derusted metal surface. The exposed clean metal surface is then ready for application of a primer coat.

In cases where the metal surface is very heavily rusted, more than one application of the composition of the present invention may be necessary to completely remove all of the rust on the surface. Further, wire brushing prior to the application of the rust removing composition often allows removal of virtually all the rust in one application.

The following examples are presented to illustrate the invention, but it is not to be considered as limited thereto. In the examples and throughout the specification, parts are by weight unless otherwise indicated.

EXAMPLE 1

A rust removing composition of the following formulation was prepared:

| | |
|---|---|
| Polyvinyl pyrrolidone (K90, 44% by wt. in water, obtained from GAF Corp.) | 10.0 wt. % |
| Sodium Lignin Sulfonate, (Kelig 32, obtained from American Can Co.) | 10.0 wt. % |
| Ascorbic Acid, Technical Grade | 5.0 wt. % |
| Water | 75.0 wt. % |

In preparing this formulation, the polyvinyl pyrrolidone was dissolved in water at approximately 100° F. to 120° F. with stirring. Next the lignin sulfonate was added and the solution was stirred until a homogeneous solution was obtained. The ascorbic acid was added last and the solution was again stirred until homogeneous.

The resulting solution was applied to rusted panels. The panels started turning black in about five minutes, and the conversion of rust into a water soluble substance was complete in about two to four hours. Time necessary for conversion of the rust depends on the degree of rust present. Additional time provides more thorough rust removal. The black coating temporarily protects the surface from corrosion. After rinsing with water under the tap or with a garden hose, the black conversion coating containing the now solubilized rust is removed exposing the clean derusted metal surface. Approximately 90 percent of the rust from a heavily rusted panel was removed after one application. A second application removed, virtually all of the remaining rust.

EXAMPLE 2

A rust removing composition having the following composition was blended using the same procedure as in Example 1:

| | |
|---|---|
| Polyvinylpyrrolidone | 10.0 wt. % |
| Sodium Lignin Sulfonate | 20.0 wt. % |
| Ascorbic Acid | 5.0 wt. % |
| Water | 65.0 wt. % |

The resulting solution was more viscous than that of Example 1 due to the higher concentration of the lignin sulfonate used.

Upon application of this formulation to heavily rusted surfaces excellent rust removal was obtained. Due to the higher viscosity, penetration was somewhat slower with this material than with the formulation of Example 1, and, therefore, it was helpful to extend reaction time before rinsing the panels with water.

EXAMPLE 3

The following formulation was prepared:

| | |
|---|---|
| Polyvinylpyrrolidone | 10.0 wt. % |
| Sodium Lignin Sulfonate | 10.0 wt. % |
| Ascorbic Acid | 15.0 wt. % |
| Water | 65.0 wt. % |

The composition of this example containing a higher level of ascorbic acid showed faster penetration and rate of rust conversion on the test panels, converting approximately 95 percent of rust on one application. Panels could be rinsed sooner than with the formulations containing lower amounts of the ascorbic acid.

EXAMPLE 5

The following formulation was prepared:

| | |
|---|---|
| Polyvinylpyrrolidone | 10.0 wt. % |
| Sodium Lignin Sulfonate | 10.0 wt. % |
| Ascorbic Acid | 20.0 wt. % |
| Water | 60.0 wt. % |

This formulation was applied in a similar way to rusted panels and removed approximately 97 percent of the rust. The greater amount of ascorbic acid reduced the conversion reaction time and yielded the best results in one operation; however, it is the most expensive of the formulations explored. Upon a second application, 100 percent of the rust was removed.

EXAMPLES 6–9

The viscosity and rheology of the rust removing solution of Example 1 can be modified with varying amounts of a thickening agent in order to improve the viscosity. In these examples, the thickening agent was hydroxyethyl cellulose which is sold commercially as the product Natrosol 250 H4R. Addition of the indicated amounts of the hydroxyethyl cellulose thickening agent modified the viscosity of the rust removing composition as set forth in the following table. The viscosity modified compositions enable the invention to be applied thixotropically to vertical surfaces. The viscosity data for these examples is as follows:

TABLE

| | | Brookfield Viscosity (cP) for 1 min | |
|---|---|---|---|
| Example | Wt % Natrosol 250 H4R ® | 30 rpm | 60 rpm |
| | 0 | 20 | 20 |
| 6 | 0.33 | 172 | 152 |
| 7 | 0.70 | — | 760 |
| 8 | 1.0 | 1260 | 1128 |
| 9 | 1.1 | 2520 | — |

EXAMPLE 10

The viscosity and rheology of the rust removing compositions of this invention can also be modified using xanthan gums such as the commercial product sold as Kelzan ®. The formulation described below which incorporates a xanthan gum thickening agent gives a Brookfield viscosity at 60 rpm using a #3 spindle of 950 cP after 1 minute. This formulation is as follows:

| | Wt % |
|---|---|
| Ascorbic Acid | 20 |
| Sodium Lignin Sulfonate | 15 |
| Polyvinylpyrrolidone | 5 |
| Kelzan ® | 1 |
| Water | 59 |

EXAMPLE 11

The formulation described below was prepared using the methods described herein:

| | Wt % |
|---|---|
| Ascorbic Acid | 20 |
| Sodium Lignin Sulfonate | 15 |
| Polyvinylpyrrolidone | 5 |
| Sodium Bicarbonate $NaHCo_3$ | 1.5 |
| Cinnamic Acid | 0.1 |
| Water | 58.4 |

In the above formulation, the cinnamic acid was a corrosion inhibitor and sodium bicarbonate was present as a buffering agent. This formulation was applied to a rusted steel panel for 1 hour. Thereafter, the solution was rinsed off with water and allowed to dry. Flash rusting which occurred on the white metal surface was subsequently removed by reapplying small amounts of the formulation with a cloth and then removing the formulation with a moist cloth. The treated surface exhibited no signs of rerusting after 48 hours.

EXAMPLE 12

The following formulation was prepared for comparison with the formulation of Example 1 of U.S. Pat. No. 4,529,450:

| | Wt % |
|---|---|
| Ascorbic Acid | 20 |
| Sodium Lignin Sulfonate | 15 |
| Polyvinylpyrrolidone | 5 |
| Proxeel CRL | 0.05 |
| Water | 59.95 |

The formulation of this example was compared by the coating method with naval jelly, a phosphate rust remover with the results shown in the graph of FIG. 1. In this case, while the naval jelly removed more rust than the composition of the present invention, this was attributable to the toxic and corrosive nature of the composition. Nevertheless, the present composition removed substantial amounts of rust by the coating method.

Figure 2:
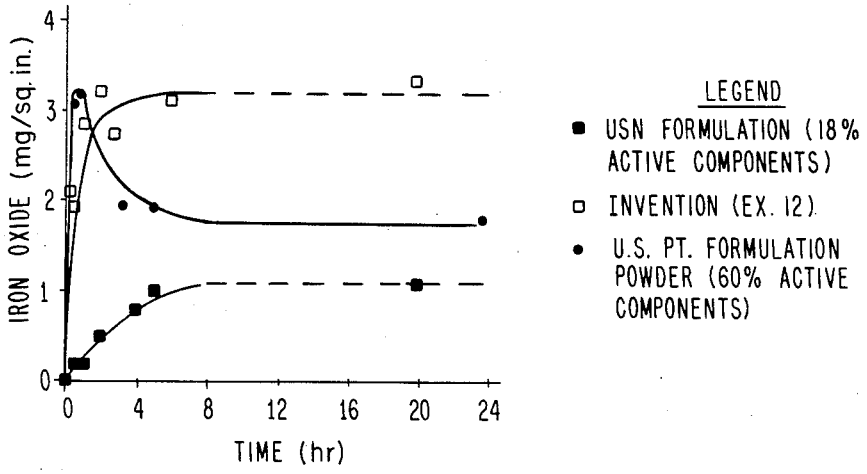
FIG. 2 is a graph showing rust removal characteristics of the composition of the invention as compared to the composition of U.S. Pat. No. 4,529,450 by the coating method.

A more relevant comparison for purposes of the present invention is set forth in FIG. 2, which is a coating test comparing the formulation of this Example 1 with the formulation of a 30% solution of Example 1 of U.S. Pat. No. 4,529,450. In this coating test, the 1 inch $\times$1 inch rusted squares described were coated on one side with a coating of each formulation ½ mil in thickness and then dried. The formulation was allowed to remain on the steel square for the times indicated by the points on the graph. The dried coating was then washed off using 100 grams of water, rinsed and then examined by atomic absorption spectroscopy. The results are reported in parts per million iron converted to milligrams of iron oxide per square inch. The powdered formulation of U.S. Pat. No. 4,529,450 was also applied in this test and is indicated by the circular points on the graph.

The results from this coating test show improvements using the composition of the present invention. It will be noted that greater amounts of iron oxide were removed than as compared with either the powdered form or the 30% solution of U.S. Pat. No. 4,529,450. These results were obtained without the necessity of a toxic and corrosive rust removal coating.

The invention has been described herein with reference to certain preferred embodiments. However, as obvious variations thereon will become apparent to those skilled in the art, the invention is not to be considered thereto.

We claim:

1. An aqueous rust transforming composition, comprising 15 to 60 weight percent active ingredients and a balance of water, said active ingredients comprising 1 to 80 weight percent ascorbic acid, 10 to 90 weight percent lignin sulfonate and 5 to 75 weight percent of a water soluble polymer.

2. A composition according to claim 1 wherein the polymer is selected from the group consisting of polyvinylpyrrolidone, polyacrylic acids, polyacrylamides, polyvinyl ethers, polyvinyl alcohols, formaldehyde resins, poly (alkyl/maleic anhydrides), poly (vinyl ether/maleic anhydrides), and mixtures thereof.

3. A composition according to claim 1 wherein the polymer is polyvinylpyrrolidone.

4. A composition according to claim 1 wherein the polymer is an acrylic polymer.

5. A composition according to claim 1 wherein the lignin sulfonate is an alkali metal or ammonium lignin sulfonate.

6. A composition according to claim 5 wherein the lignin sulfonate is sodium lignin sulfonate.

7. A composition according to claim 1 wherein the ascorbic acid is present in an amount from 11–50 weight %, the lignin sulfonate is present in an amount from 25–66 weight %, and the polymer is present in an amount from 22–40 weight %

8. A composition according to claim 1 wherein the composition also contains a thickening agent.

9. A composition according to claim 1 wherein the thickening agent comprises a natural polymer.

10. A composition according to claim 8 wherein the thickening agent is hydroxyethyl cellulose or a xanthan gum.

11. A composition according to claim 1 wherein the composition also contains a corrosion inhibiting component.

12. A composition according to claim 1 wherein the composition also contains a buffer.

13. A composition according to claim 1 wherein the lignin sulfonate is an alkali metal or ammonium lignin sulfonate and the water soluble polymer is polyvinylpyrrolidone.

14. A method of converting and removing rust from a rusted metal surface by applying to the rusted metal surface an aqueous rust transforming composition comprising from 1 to 80 weight percent ascorbic acid, from 10 to 90 weight percent lignin sulfonate, from 5 to 75 weight percent of a water soluble polymer, and a balance of water.

15. A method according to claim 14, wherein the composition is applied to the rusted metal surface as a coating.

16. A method according to claim 14, wherein the composition is applied to the rusted metal surface, allowed to remain on the surface until at least 90% of the rust is converted to a water soluble substance, and then removed from the surface by washing with water.

* * * * *